US006398512B2

(12) United States Patent
Stewart

(10) Patent No.: US 6,398,512 B2
(45) **Date of Patent: *Jun. 4, 2002**

(54) METHOD AND APPARATUS FOR COOLING AND EXPELLING EXHAUST GASES FROM A WATER HEATER

(76) Inventor: Dale Stewart, Rte. 3, Box 147, Aurora, MO (US) 65605

( * ) Notice: Subject to any disclaimer, the term of this patent is extended or adjusted under 35 U.S.C. 154(b) by 0 days.

This patent is subject to a terminal disclaimer.

(21) Appl. No.: 09/757,983

(22) Filed: Jan. 10, 2001

Related U.S. Application Data

(63) Continuation-in-part of application No. 09/398,484, filed on Sep. 17, 1999, now Pat. No. 6,231,311.

(51) Int. Cl.[7] ..... F04B 19/24
(52) U.S. Cl. ..... 417/53
(58) Field of Search ..... 417/53, 366, 372; 415/3; 236/10; 126/45, 116, 312; 122/17, 14.01, 44, 13.1; 110/47

(56) References Cited

U.S. PATENT DOCUMENTS 2,188,741 A * 1/1940 Roberts ..... 98/72
3,777,975 A * 12/1973 Kofink ..... 237/12.3 A
4,225,292 A * 9/1980 Hallerback et al. ..... 417/367
4,475,868 A * 10/1984 Renger ..... 415/225
4,799,855 A * 1/1989 Milocco et al. ..... 415/143
5,277,232 A * 1/1994 Borsheim ..... 141/65
5,352,099 A * 10/1994 Anstine et al. ..... 417/366
5,375,651 A * 12/1994 Colwell ..... 165/47
5,385,444 A * 1/1995 Kobayashi et al.

* cited by examiner

*Primary Examiner*—Teresa Walberg
*Assistant Examiner*—Daniel Robinson
(74) *Attorney, Agent, or Firm*—Andrus, Sceales, Starke & Sawall, LLP

(57) ABSTRACT

A blower unit is disclosed which seals atop a conventional water heater. The unit utilizes a one-piece housing divided into two chambers which are in fluid communication; the first chamber houses the impeller, while the second chamber houses the exhaust flue of the water heater. An inlet plate having an inlet opening is disposed between the two chambers. The blower motor is separated from the blower housing to prevent heated exhaust gases from heating the motor. During operation, dilution air and exhaust gases are drawn into the blower housing and mixed together to reduce the temperature of the exhaust gases. The gas mixture is then expelled from the unit via an exhaust outlet in the blower housing.

21 Claims, 6 Drawing Sheets

METHOD AND APPARATUS FOR COOLING AND EXPELLING EXHAUST GASES FROM A WATER HEATER

CROSS-REFERENCE TO RELATED APPLICATIONS

This application is filed under 37 C.F.R. 1.53(b) and is a continuation-in-part of application Ser. No. 09/398,484, filed Sep. 17, 1999 U.S. Pat. No. 6,231,311.

TECHNICAL FIELD

This invention relates generally to draft inducers for hot water heaters. More particularly, the present invention relates to blower designs for cooling and expelling heated flue gases emanating from conventional hot water heaters.

BACKGROUND ART

The water heater has been around for many years to provide a supply of heated water for both commercial and consumer usage. To generate the requisite thermal energy needed to increase the temperature of the water therein, a gas or oil fired burner is commonly employed. The burner produces hot combustion gases (flue gases) that need to be drawn through the flue of the water heater via the most rigorous path allowable in order to minimize heat losses and maximize the overall efficiency of the water heater.

To move the gases through the water heater, centrifugal blowers were engineered into the system. This allowed the most rigorous path possible for the flue, which in turn increased the amount of heat transferred from the flue gases to the water. An additional benefit of the use of a blower with a water heater was that the temperatures of the exhaust gases exiting the flue were reduced due to more efficient heat scrubbing. However, in naturally aspirated water heaters, the gases exiting the water heater were still extremely hot. This required the use of steel exhaust tubing, which needed to be vented to the outside of the structure in a nearly vertical manner for safety. By using a blower, the temperatures of the exhaust gases were reduced to the point that a wider array of materials became available for exhaust piping. Specifically, this allowed for the safe use of PVC piping and horizontal venting through the nearest wall to vent the exhaust gases to the outside atmosphere.

However, the utilization of a blower in conjunction with a water heater presented several challenges. The exhaust gases in the flue, while much lower in temperature than normally aspirated water heaters, were still above ideal temperatures for direct venting through PVC piping. To achieve desirable temperature levels, dilution (cooling) air at ambient temperature was introduced into the system and mixed with the hot exhaust gases from the flue. Hence, the complexity and expense of the blower assisted water heater was introduced when exhaust gases were mixed with the dilution air.

Attention is drawn to a solution for adding dilution air to exhaust gases, which employed intricate plumbing layouts that increased manufacturing costs and increased potential failure sources through the myriad of connections. This solution involved the use of a T-connection attached to the flue with dilution air being drawn through the connection along with the hot exhaust gases. The entire blower assembly required multiple tubes, connections and other heat resistant components to direct the exhaust gases and dilution air through and out of the water heater/blower system.

An additional problem surrounding this solution was that exhaust fumes could potentially make contact with the blower motor thereby causing the blower motor to overheat, which affected the longevity of the motor and overall efficiency of the blower unit. Additionally, exhaust gases contacting the motor were able to leak into the ambient thereby creating various health risks due to the toxicity of the exhaust fumes.

The instant invention solves many of the problems with the plumbing and mixing of the hot exhaust gases with dilution air. Additionally, the instant invention reduces production and maintenance costs while increasing the overall safety, efficiency and durability of the water heater blower assembly.

DISCLOSURE OF THE INVENTION

The present invention provides an improved motor blower assembly as described herein. Said motor blower assembly, or dilution air blower, includes a blower housing that mounts and seals to a conventional hot water heater and is sized to fit between the heater's inlet and outlet water pipes. Said blower housing is vented in order to draw dilution air into the blower unit to cool the flue gases expelled from the water heater.

The one-piece blower housing has three apertures on its top surface to receive bolts to secure a conventional motor to the blower housing, and one radially centered aperture to receive the motor shaft. The blower housing has portions defining a first chamber for receiving an impeller. The impeller is fixed to a motor shaft attached to the rotor of a motor. Additionally, the housing has portions which define an exhaust outlet that is in fluid communication with the first chamber. The outlet provides egress for exhaust gases emanating from a hot water heater to which the blower is attached.

A blower housing cover or inlet plate is provided which is attached to the blower housing at an intermediate location along the sidewall of the blower housing. The inlet plate has an inlet opening to allow dilution air and exhaust gases from a hot water heater to enter the first chamber.

The sidewall of the blower housing extends beyond the inlet plate and forms a first and second skirt. The blower housing is vented through the provision of at least one vent opening or slot disposed within the second skirt. Both the first and second skirt have portions defining a flange adapted for securing the blower housing to the top of a hot water heater. The combination of the lower portion of the housing sidewall, the first and second skirt, the inlet plate, and the top of the water heater form a second chamber within which a flue pipe of the hot water heater is confined. The second chamber is in fluid communication with the first chamber via the inlet aperture of the inlet plate.

When the impeller is rotated, a negative pressure is created in the first chamber. This negative pressure draws dilution air through the at least one vent slot or opening in the skirt section of the housing, and draws exhaust gases from the hot water heater. The dilution air mixes with the hot exhaust gases in the second chamber, which significantly reduces the temperature of the gases to an acceptable level for expulsion. The gas/air mixture is then drawn into the first chamber where it is forced through the outlet portion of the blower housing.

BRIEF DESCRIPTION OF DRAWINGS

Reference is made to the accompanying drawing in which is shown an illustrative embodiment of the invention from which its novel features will be apparent.

In the drawing.

MODE FOR CARRYING OUT THE INVENTION

Figure 1:
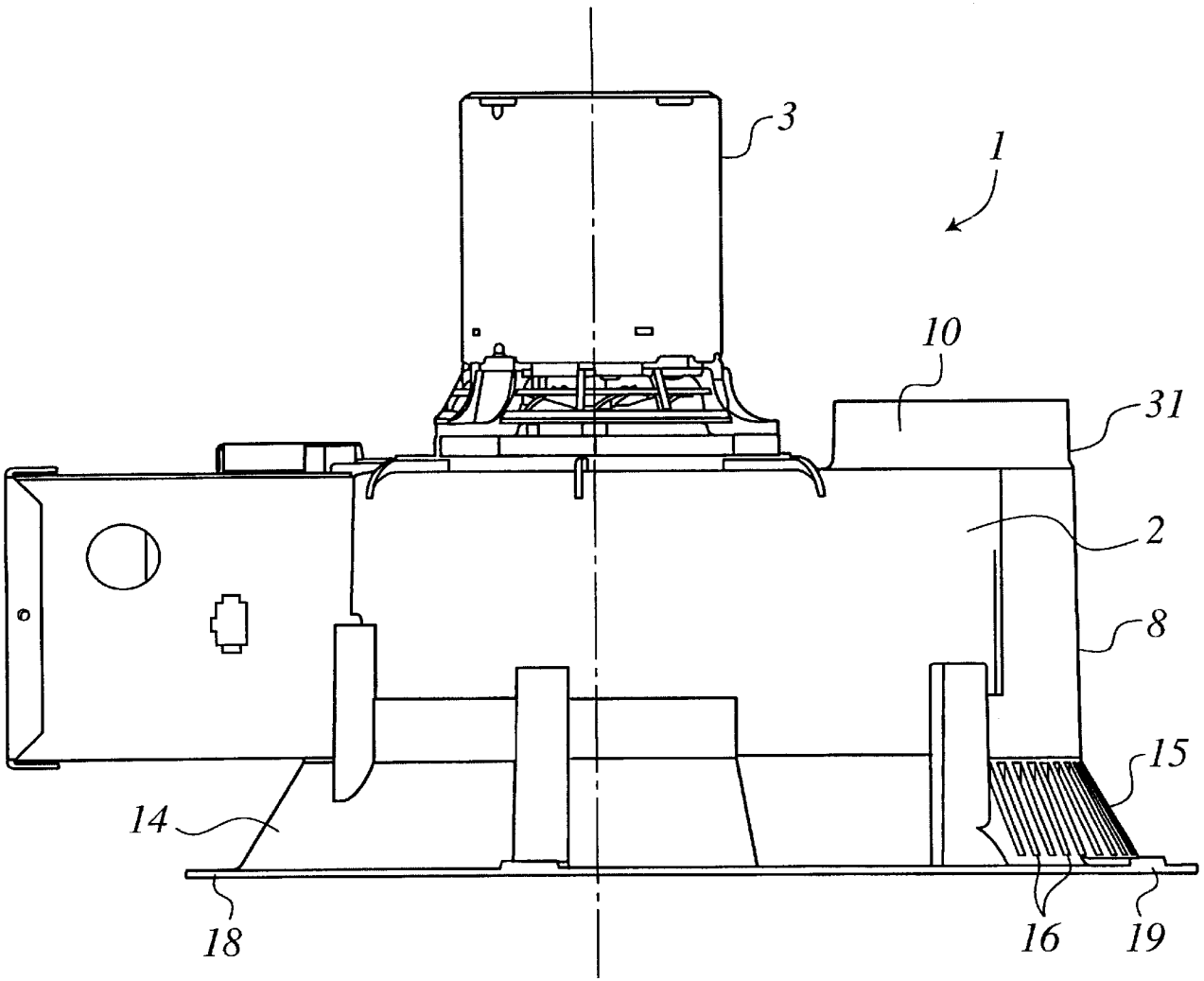
FIG. 1 shows a side view of the dilution air blower in accordance with the invention.

At the outset, the invention is described in its broadest overall aspects with a more detailed description following. Accordingly, a conventional hot water heater includes a combustion air inlet, a combustion air chamber, a heat recovery section, a draft inducer and a combustion gas exhaust. When the water heater is in operation, the draft inducer or water heater blower creates a negative pressure or induces a draft in the water heater so air for combustion is drawn into the air inlet and then into the combustion chamber. Once in the combustion chamber, the air is mixed with fuel such as natural gas for combustion or burning (i.e., the heat energy source). The heat energy of the combustion process is then extracted from the combustion or exhaust gases (flue gases) in the heat recovery section, which also results in the reduction in the temperature of said gases.

After passing through the heat recovery section of the water heater, the relatively cooler combustion gases are drawn into the water heater blower by the rotation of the impeller or rotating blades within said blower. The rotation of the impeller or rotating blades generates the draft (negative pressure) which draws the air for combustion into and through the hot water heater and its heat recovery sections. The combustion gases are then expelled via the water heater blower through an exhaust pipe out to the atmosphere.

To provide an even, efficient flow of gases, it is important that the housing for the blower be adequately sealed so that gases are drawn into the blower at an inlet and exhausted at an outlet. Any leaks in the housing will inevitably lead to the inefficiency and incomplete removal of combustion gases. Additionally, it is imperative that the combustion gases are not allowed to escape into the ambient, as these gases are toxic.

Equally important is a means to cool the blower motor during operation. To provide effective cooling while preventing hot exhaust gases from entering into the motor housing (i.e., to prevent the exhaust gases from heating the motor), the blower motor housing is separated from the blower housing such that the pressure at the point where the blower motor shaft enters the blower housing is maintained at a slight vacuum. Furthermore, a cooling fan housed in a vented mounting plate for the motor is attached to the motor shaft to draw air through the motor assembly.

To accomplish all of these functions as well as others, a new dilution air blower has been devised. The blower incorporates a one-piece housing that seals on the full circumference of its mounting base atop a conventional water heater or any other device requiring exhaust expulsion. The housing is designed to form a vented skirt, which extends beyond the housing sidewall so that two chambers are formed which are in fluid communication with one another. A first chamber located in the upper portion of the housing encompasses the impeller, while a second chamber located in the lower portion of the housing, houses the water heater flue. Separating the chambers is an inlet plate having portions defining an opening or inlet to allow the flue gas/dilution air mixture to pass from the second chamber to the first chamber.

Figure 2:
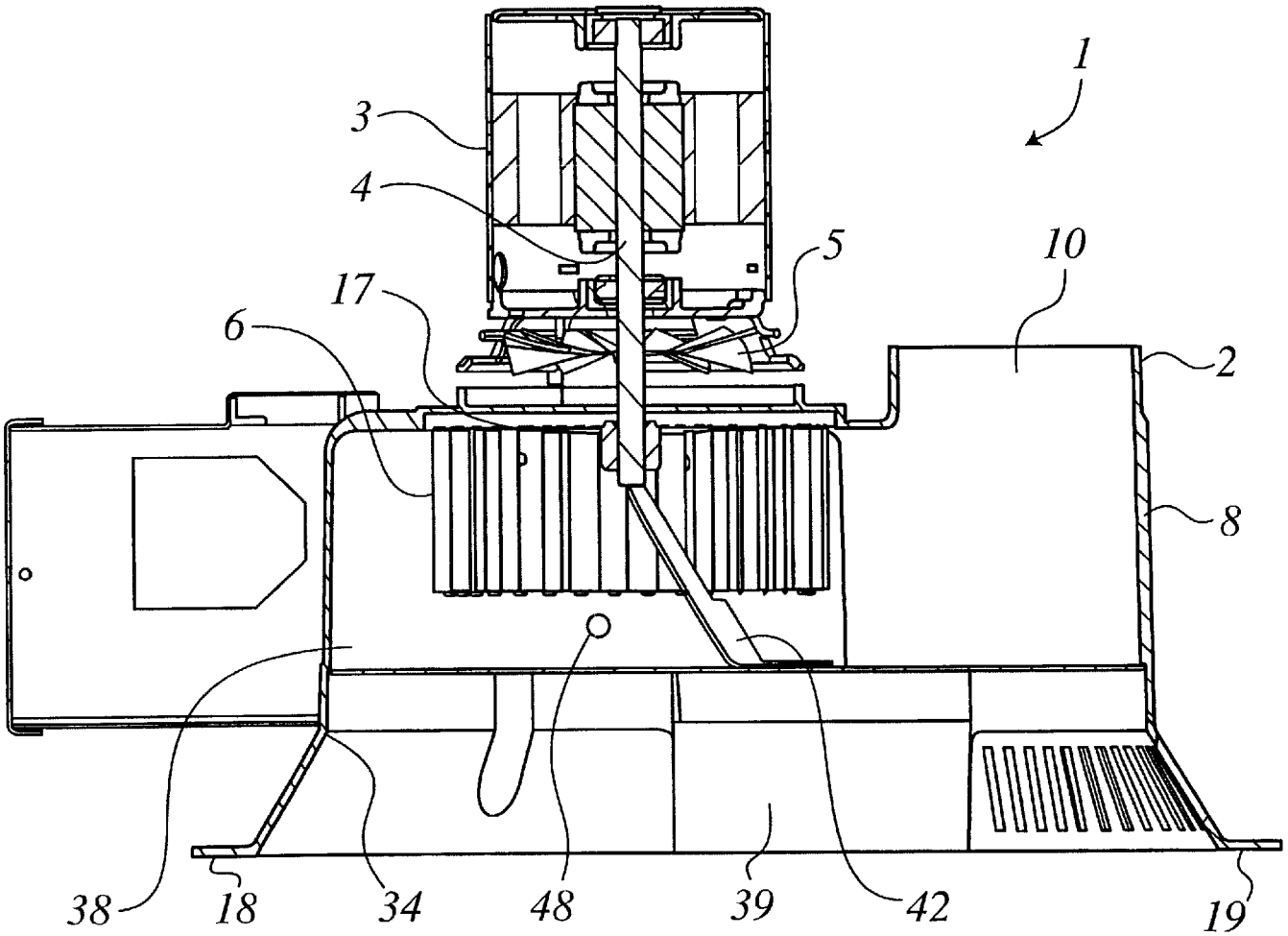
FIG. 2 shows a side cut-away view of the dilution air blower in accordance with the invention.
Figure 5:
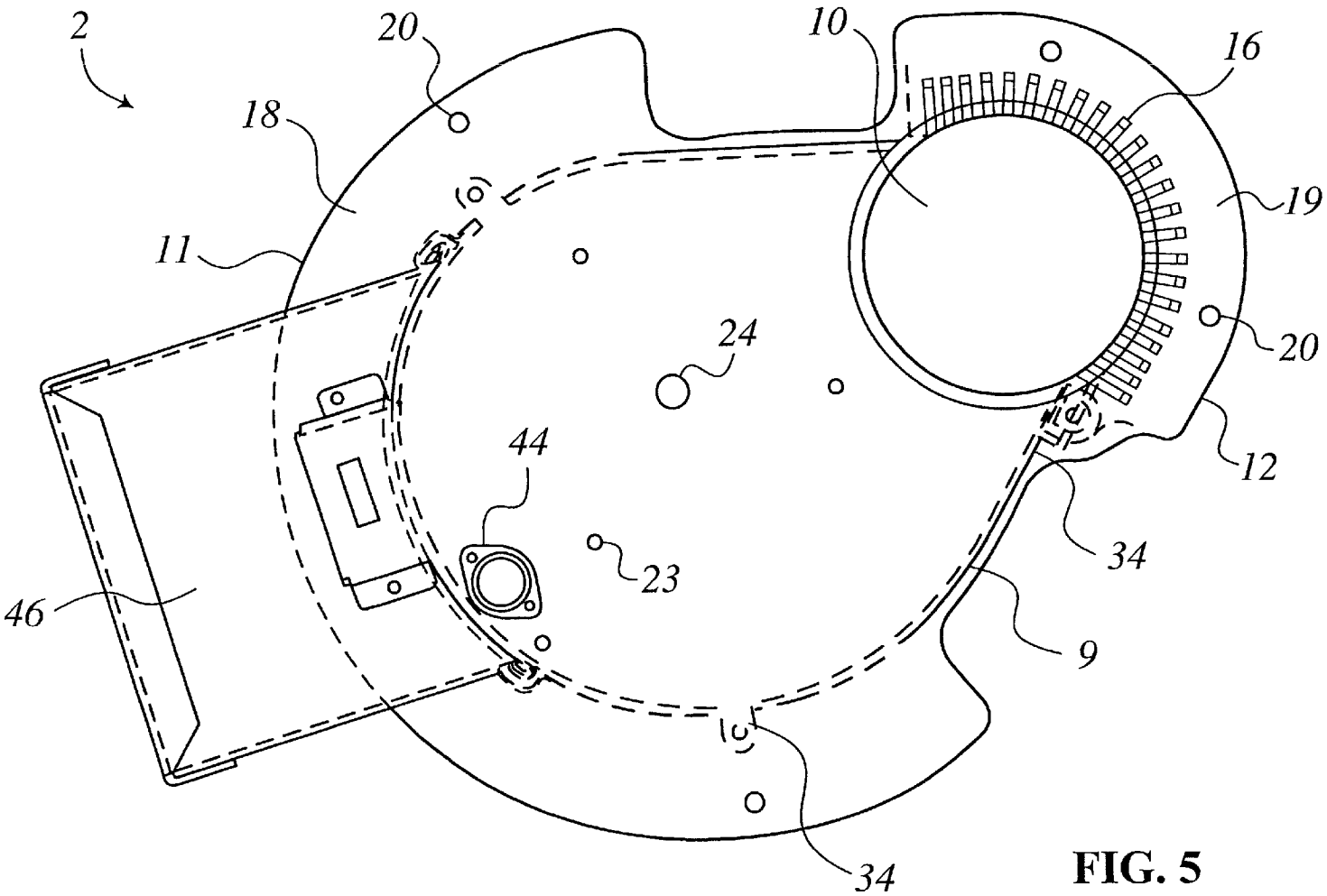
FIG. 5 shows a top view of the dilution air blower housing in accordance with the invention.

Referring to FIGS. 1–2 and 5, a dilution air blower 1 is shown which provides a blower motor assembly and blower housing that attaches directly to a hot water heater (not shown).

Said dilution air lower 1 comprises a blower housing 2 adapted to receive a conventional blower motor 3. Motor mounting bores 23 are provided on the top surface of the motor housing 2 for receiving mechanical fasteners (not shown) to secure said blower motor 3 to said blower housing 2. Additionally, the top surface of the blower housing 2 defines an aperture 24 for receiving a motor shaft. The blower motor 3 is positioned on the outside of the blower housing 2 prevent heated exhaust gases emanating from the water heater from making contact with the blower motor 3 to keep the blower motor 3 from overheating.

The blower Motor 3 has a motor shaft 4 for receiving a cooling fan 5 and an impeller 6. At the base of said motor is a vented shroud 7 configured to enclose a cooling fan 5. Directly attached to the motor shaft 4 is the cooling fan 5, which is freely rotatable within the vented shroud 7 to cool the motor during operation. Also attached to the motor shaft 4 is an impeller 6, which is freely rotatable within dilution air blower 1. The impeller 6 is fitted with an optional non-vented backplate 17 to provide structural integrity.

Figure 4:
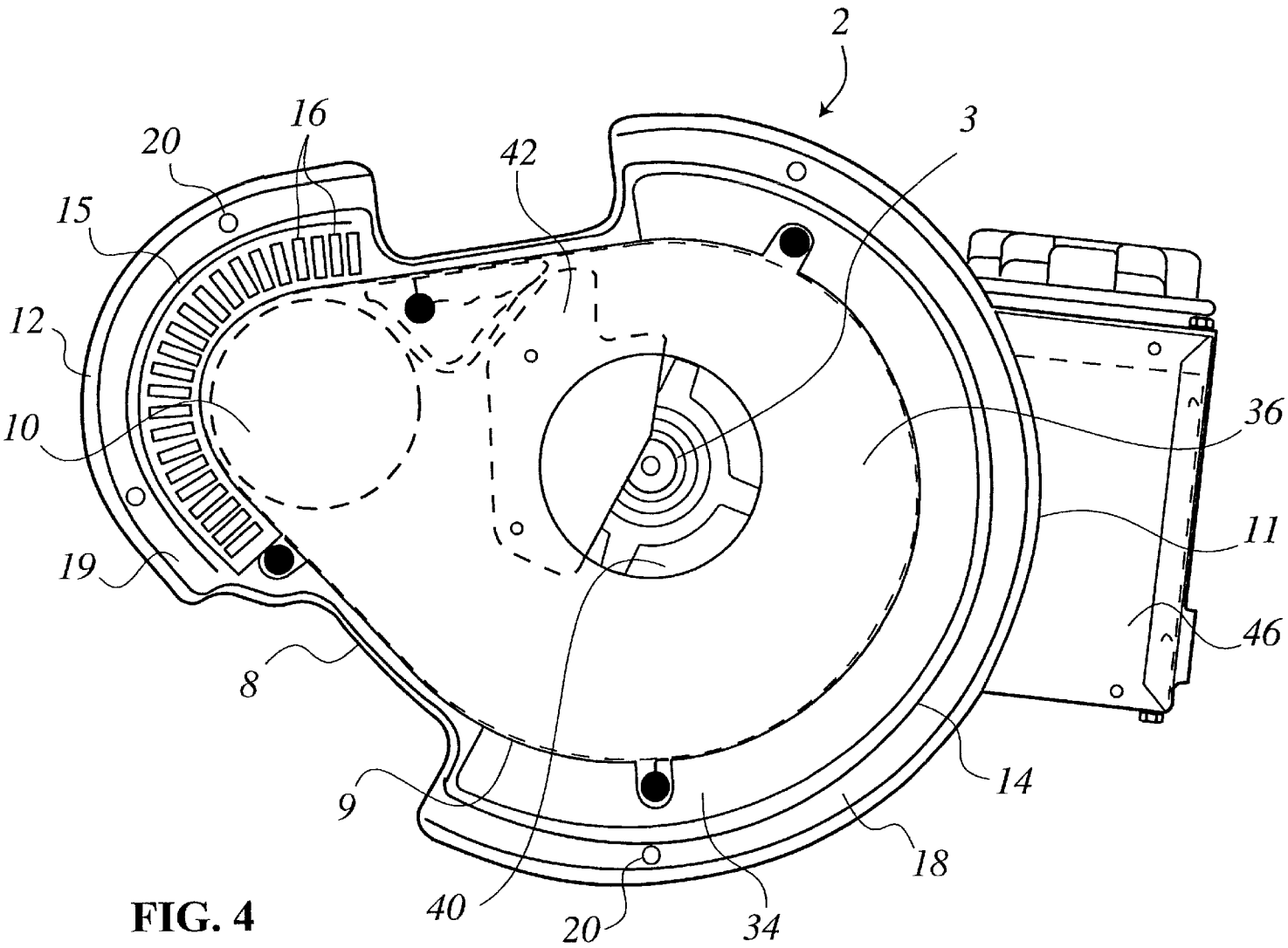
FIG. 4 shows a bottom view of the dilution air blower in accordance with the invention.

Said blower housing 2 has a blower housing sidewall 8 within which the impeller 6 is situated. Side wall 8 preferably has an inner surface 9 that is scroll shaped (as shown in FIG. 4) to maximize the efficient flow of exhaust gases into an exhaust outlet 10 formed in blower housing 2. Exhaust outlet 10 preferably has a shoulder 31 which is provided as a seat to an exhaust pipe (not shown) used to channel the exhaust gases out of an enclosed structure such as a house basement.

Referring now to FIGS. 1 and 5, a blower housing 2 is shown which is adapted to fit about the infeed and outfeed water lines of a hot water heater. In this embodiment, the blower housing 2 is shaped such that a first or larger end 11 and a second or smaller end 12 are formed. The exhaust outlet 10 is situated near the second end 12, while the blower motor 3 is positioned towards the first end 11. First end 11 has portions defining a first skirt 14. Second end 12 has portions defining a second skirt 15. The blower housing 2 is vented by the provision of at least one vent opening or slot 16 disposed in the second skirt 15, which can be modified to enable the dilution air blower to fit different makes and models of water heaters. The at least one vent opening or slot 16 allows dilution air to flow into the blower housing.

Figure 3:
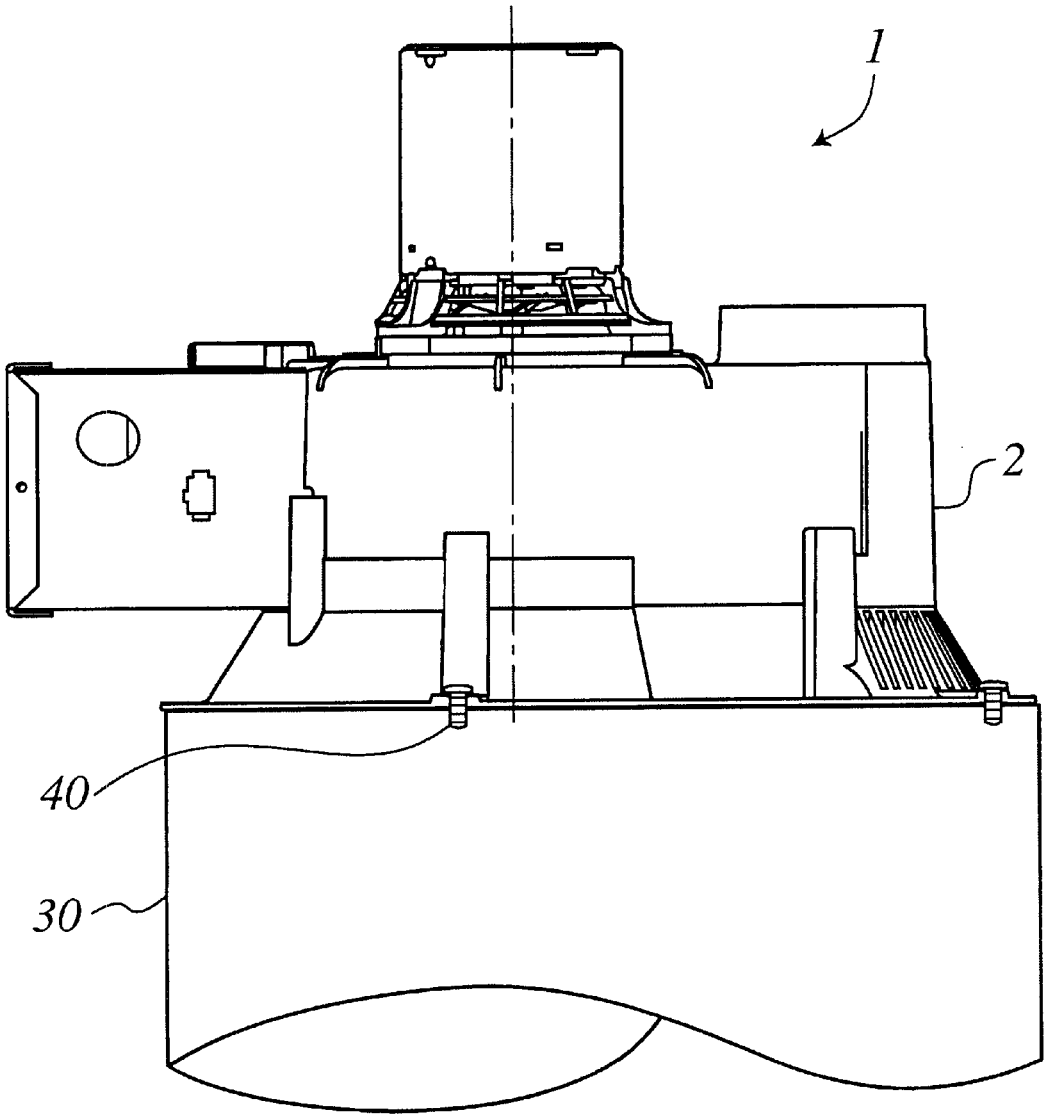
FIG. 3 shows a side view of the dilution air blower mounted atop a conventional water heater in accordance with the invention.

A first flange 18 extends radially from the first skirt 14 and a second flange 19 extends radially from the second skirt 15. Flange bores 20 are provided in said flanges 18,19 for securing and sealing the blower housing 2 to the water heater 30 with any variety of mechanical fasteners such as hex bolts 40, as shown in FIG. 3. By design, the blower housing 2 of the dilution air blower is secured directly to the water heater, particularly to the top surface, and forms a seal around the full circumference of its mounting base. The housing 2 is positioned such that an exhaust flue (not shown) of the water heater is biased towards the second skirt 15. Furthermore, the housing 2 is configured such that the water heater exhaust flue protrudes into a lower chamber or second chamber 39 (FIG. 2) of the blower housing 2, but does not protrude into an upper or first chamber 38 (FIG. 2) of the blower housing 2 (the upper and lower chambers will be described in more detail below), which is critical to the operation of the dilution air blower 1.

Figure 6:
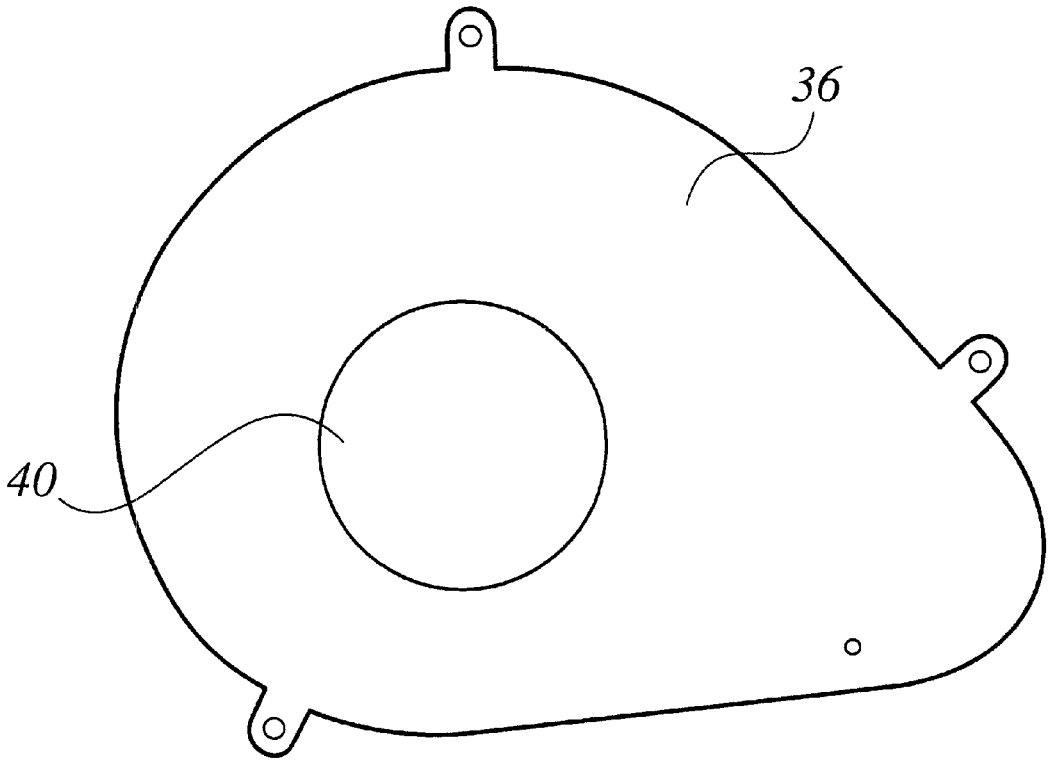
FIG. 6 shows a bottom view of the inlet plate in accordance with the invention.

Turning to FIGS. 2,4 and 5, a side view, bottom view and top view of the blower housing 2 are respectively shown. An inlet shoulder 34 is formed and is preferably scroll-shaped to allow for the efficient flow of exhaust gases towards the exhaust outlet 10. An inlet plate 36 (shown in FIG. 6), which is sized and shaped to fit within the blower housing 2 is secured to the inlet shoulder 34 with any of a variety of attachment methods such as clips, self-tapping screws, adhesives, mating locking surfaces, etc. The method to secure the inlet plate 36 to the blower housing 2 is not particularly important so long as the seal between the blower housing 2 and the inlet plate 36 is tight. A first chamber 38 (FIG. 2) for housing the impeller 6 is formed by the combination of the upper section of the blower housing sidewall 8, the top section of the blower housing 2 and the inlet plate 36. A second chamber 39 (FIG. 2) for housing the water heater flue, is formed by the combination of the lower section of the blower housing sidewall 8, the first and second skirt 14,15, the surface of the water heater to which the blower unit is directly attached (not shown), and the inlet plate 36. The inlet plate 36 separates the first and second chambers of the blower housing and has portions defining an inlet opening 40 that keeps the first chamber and second chamber in fluid communication.

Attached to the inlet plate 36 is a guide vane 42, which extends into the inlet portion of the impeller 6. Said guide vane, available under the trade name "Swirlator" and described in U.S. Pat. No. 4,549,848, guides the incoming flue gas and dilution air mix into the inlet of the impeller 6 and re-circulates the gas/air mixture in the impeller to increase the pressure level achieved by the rotating impeller.

Attached to the blower housing 2 is an over temperature protector transducer 44. Said transducer acts to shut down the dilution air blower in the event that the blower motor fails, or the dilution vents in the second skirt and/or the exhaust section of the blower housing become blocked. Additionally, an optional auxiliary box 46 for housing the water heater and dilution air blower controls is affixed to the blower housing opposite the exhaust outlet 10, while an optional vacuum port 48 (FIG.2) is positioned in the blower housing sidewall 8 to work with the water heater if necessary.

Having described the components of dilution air blower 1, attention will now be drawn its operation. Operation of the blower motor 3 causes the rotation of the impeller 6 and the motor cooling fan 5. Rotation of the impeller 6 generates negative air pressure in the first chamber 38, which causes air and combustion gases to be drawn into the first chamber 38 from the second chamber 39. Additionally, rotation of the impeller 6 creates a slight vacuum at the point where the motor shaft 4 passes into the blower housing 2 thus preventing heated exhaust gases from coming in contact with the blower motor 3. The drawing of air and combustion gases from the second chamber 39 causes the development of negative air pressure in the second chamber 39. This negative air pressure causes dilution air to pass through the at least one housing vent opening or slot 16 in the second skirt 15.

The dilution air passing into the second chamber 39 mixes with exhaust gases flowing out of the rigorous water heater flue path resulting in a desirable reduction in temperature of the exhaust gases. The mixed dilution air and exhaust gases are then drawn into the first chamber 38 through the inlet opening 40 of the inlet plate 36 and guided into the opening of the impeller via the guide vane 42. Said guide vane 42 re-circulates the mixed gases, which increases the overall amount of pressure generated by the rotating impeller 6. Finally, the rotation of the impeller 6 drives the mixed gases into the exhaust outlet 10 for final expulsion from the hot water heater system.

To control the flow of dilution air from the second chamber 39, the size, shape and number of vent openings or slots 16 in the second skirt 15 can be modified. Any reduction in the number of second skirt vent openings or slots 16 will lesson the amount of dilution air entering the blower. Conversely, an increase in the number of vent openings or slots will increase the amount of dilution air entering the dilution air blower unit 1. It is to be cautioned that too many vent slots will cause an undesirable reduction in negative air pressure development, which will render the system inefficient. On the other hand, even one skirt vent slot could be used to accomplish the cooling tasks.

It is to be understood that the present invention is by no means limited to the particular constructions herein disclosed and/or shown in the drawings, but also comprises any modifications or equivalents within the scope of the claims.

I claim:

1. A dilution air blower comprising:

a blower housing;

an inlet plate having an opening;

a first chamber;

a second chamber, wherein the second chamber is separated from the first chamber by the inlet plate and is in fluid communication with the first chamber;

a housing vent, the housing vent allowing dilution air to enter the second chamber;

an exhaust outlet in fluid communication with the first chamber;

an external blower motor having a motor shaft, the blower motor being attached to the blower housing; and an impeller secured to the motor shaft and disposed in the first chamber.

2. The dilution air blower of claim 1, wherein the blower housing further includes a sidewall defining an inlet shoulder for receiving the inlet plate.

3. The dilution air blower of claim 1, further including a guide vane attached to the inlet plate and extending into the impeller.

4. The dilution air-blower of claim 1, wherein the blower housing has a first end having a first diameter and a second end having a second diameter that is smaller than the first diameter.

5. The dilution air blower of claim 4, having a first skirt portion extending from the first end and a second skirt portion extending from the second end.

6. The dilution air blower of claim 5, wherein the first skirt portion and the second skirt portion respectively includes a first radially extended flange and a second radially extended flange.

7. The dilution air blower of claim 5, wherein the housing vent consists of at least one slot placed in the second skirt.

8. A dilution air blower and water heater assembly comprising:

a water heater comprising a top surface, and an exhaust flue; and a dilution air blower disposed at a surface of the water heater comprising;

a blower housing;

an inlet plate having an opening;

a first chamber;

a second chamber, wherein the second chamber is separated from the first chamber by the inlet plate and is in fluid communication with the first chamber;

a housing vent, the housing vent allowing dilution air to enter the second chamber;

an exhaust outlet in fluid communication with the first chamber;

an external blower motor having a motor shaft, the blower motor being attached to the blower housing; and an impeller secured to the motor shaft and disposed in the first chamber.

9. The dilution air blower and water heater assembly of claim 8, further including a guide vane attached to the inlet plate and extending into the impeller.

10. The dilution air blower and water heater assembly of claim 8, wherein the blower housing further includes a sidewall defining an inlet shoulder for receiving the inlet plate.

11. The dilution air blower and water heater assembly of claim 8, wherein the water heater exhaust flue protrudes into the second chamber, but does not protrude into the first chamber.

12. The dilution air blower and water heater assembly of claim 8, wherein the blower housing has a first end having a first diameter and a second end having a second diameter that is smaller than the first diameter.

13. The dilution air blower and water heater assembly of claim 12, wherein a first skirt portion extends from the first end and a second skirt portion extends from the second end.

14. The dilution air blower and water heater assembly of claim 13, wherein the first skirt portion and the second skirt portion respectively includes a first radially extended flange and a second radially extended flange, both first and second radially extended flanges acting to secure and seal the dilution air blower to the water heater.

15. The dilution air blower and water heater assembly of claim 13, wherein the housing vent consists of at least one slot placed in the second skirt.

16. A method of providing dilution air to a dilution air blower and water heater assembly comprising the steps of:

providing a water heater comprising a top surface, and an exhaust flue;

providing a dilution air blower disposed at a surface of the water heater comprising;

a blower housing;

an inlet plate having an opening;

a first chamber;

a second chamber, wherein the second chamber is separated from the first chamber by the inlet plate and is in fluid communication with the first chamber;

a housing vent, the housing vent allowing dilution air to enter the second chamber;

an exhaust outlet in fluid communication with the first chamber;

an external blower motor having a motor shaft, the blower motor being attached to the blower housing; and an impeller secured to the motor shaft and disposed in the first chamber;

rotating the impeller to develop negative air pressure in the first chamber to draw air from the second chamber into the first chamber;

generating negative air pressure in the second chamber;

drawing dilution air into the second chamber via the housing vent;

drawing exhaust gases through the water heater flue and into the second chamber;

cooling exhaust gases flowing out of the exhaust flue with the dilution air entering the second chamber via the housing vent to form a gas mixture;

drawing the gas mixture into the first chamber and impeller via the opening in the inlet plate;

expelling the gas mixture from the dilution air blower via the exhaust outlet.

17. The method of claim 16, further comprising the steps of:

attaching a guide vane to the inlet plate and extending into the impeller;

recirculating the gas mixture inside the impeller via the guide vane to generate additional pressure.

18. The method of claim 16, further comprising the step of providing a blower housing having a first end having a first diameter and a second end having a second diameter that is smaller than the first diameter.

19. The method of claim 18, wherein a first skirt portion extends from the first end and a second skirt portion extends from the second end.

20. The method of claim 19, wherein the first skirt portion and the second skirt portion respectively includes a first radially extended flange and a second radially extended flange, both first and second radially extended flanges acting to secure and seal the dilution air blower to the water heater.

21. The method of claim 19, wherein the housing vent consists of at least one slot placed in the second skirt.

* * * * *